US010431928B2

(12) United States Patent
Volkmann et al.

(10) Patent No.: US 10,431,928 B2
(45) Date of Patent: Oct. 1, 2019

(54) ANGLED CONTACT PIN FOR BEING PRESSED INTO A CONTACT PIN RECEPTACLE, A CONNECTOR WITH AT LEAST ONE CONTACT PIN AND A METHOD FOR PRODUCING A CONNECTOR

(71) Applicant: TE Connectivity Germany GmbH, Bensheim (DE)

(72) Inventors: Daniel Volkmann, Lautertal (DE); Anne Weiss, Alsbach-Haehnlein (DE)

(73) Assignee: TE Connectivity Germany GmbH, Bensheim (DE)

( * ) Notice: Subject to any disclaimer, the term of this patent is extended or adjusted under 35 U.S.C. 154(b) by 0 days.

(21) Appl. No.: 15/720,581

(22) Filed: Sep. 29, 2017

(65) Prior Publication Data

US 2018/0026397 A1 Jan. 25, 2018

Related U.S. Application Data

(63) Continuation of application No. PCT/EP2016/056909, filed on Mar. 30, 2016.

(30) Foreign Application Priority Data

Apr. 1, 2015 (DE) ..... 10 2015 205 964

(51) Int. Cl.
*H01R 13/631* (2006.01)
*H01R 12/72* (2011.01)
(Continued)

(52) U.S. Cl.
CPC ..... *H01R 13/631* (2013.01); *H01R 12/724* (2013.01); *H01R 43/048* (2013.01); *H01R 43/22* (2013.01); *H01R 2101/00* (2013.01)

(58) Field of Classification Search
CPC ..... H01R 13/057; H01R 13/41; H01R 43/16; H01R 43/20; H01R 12/585
(Continued)

(56) References Cited

U.S. PATENT DOCUMENTS 5,127,839 A * 7/1992 Korsunsky ..... H01R 13/6585 439/79
5,374,204 A 12/1994 Foley et al.
(Continued)

FOREIGN PATENT DOCUMENTS

CN 102570125 A 7/2012
CN 104319509 A 1/2015
(Continued)

OTHER PUBLICATIONS

Abstract of JP2013037928, dated Feb. 21, 2013, 1 page.
(Continued)

*Primary Examiner* — Hien D Vu
(74) *Attorney, Agent, or Firm* — Barley Snyder

(57) ABSTRACT

A contact pin comprises a contact section, a mounting section angled with respect to the contact section, and a transition region connecting the contact section and the mounting section. The contact section extends substantially parallel to a contacting direction in which the contact pin is pressed into a contact pin receptacle. The transition region has a recess forming a substantially planar engagement surface.

19 Claims, 3 Drawing Sheets

(51) Int. Cl.
*H01R 43/22* (2006.01)
*H01R 43/048* (2006.01)
*H01R 101/00* (2006.01)

(58) Field of Classification Search
USPC ..... 439/733.1, 884, 741, 742, 79
See application file for complete search history.

(56) References Cited

U.S. PATENT DOCUMENTS

| | | | | |
|---|---|---|---|---|
| 6,183,302 | B1 * | 2/2001 | Daikuhara | H01R 24/44 439/108 |
| 6,461,175 | B2 * | 10/2002 | Okamoto | H01R 12/727 439/733.1 |
| 7,563,111 | B2 | 7/2009 | Kinoshita et al. | |
| 8,616,901 | B2 * | 12/2013 | Shindo | H01R 12/724 439/540.1 |
| 9,350,131 | B2 * | 5/2016 | Beck | H01R 12/585 |
| 2001/0006854 | A1 * | 7/2001 | Moriwake | H01R 43/16 439/78 |
| 2009/0117755 | A1 | 5/2009 | Tonosaki | |
| 2012/0164851 | A1 | 6/2012 | Shindo | |
| 2015/0044916 | A1 | 2/2015 | Beck et al. | |

FOREIGN PATENT DOCUMENTS

| | | | |
|---|---|---|---|
| EP | 1107400 | A1 | 6/2001 |
| EP | 2472677 | A2 | 7/2012 |
| JP | H07-192799 | A | 7/1995 |
| JP | H09-139262 | A | 5/1997 |
| JP | 2001-230004 | A | 8/2001 |
| JP | 2009-117064 | A | 5/2009 |
| JP | 2012-142152 | A | 7/2012 |
| JP | 2013-037928 | A | 2/2013 |

OTHER PUBLICATIONS

PCT International Search Report, dated Jun. 3, 2016, 10 pages.
Chinese First Office Action and English translation, Chinese Patent Application No. 201680018824.9, dated Nov. 27, 2018, 16 pages.
Japanese Notice of Reasons for Refusal, dated Sep. 25, 2018, 15 pages.
Abstract of JPH09-139262 A, dated May 27, 1997, 1 page.
Abstract of JP 2001-230004 A, dated Aug. 24, 2001, 2 pages.
Abstract of JP 2013-037928 A, dated Feb. 21, 2013, 1 page.

* cited by examiner

ANGLED CONTACT PIN FOR BEING PRESSED INTO A CONTACT PIN RECEPTACLE, A CONNECTOR WITH AT LEAST ONE CONTACT PIN AND A METHOD FOR PRODUCING A CONNECTOR

CROSS-REFERENCE TO RELATED APPLICATIONS

This application is a continuation of PCT International Application No. PCT/EP2016/056909, filed on Mar. 30, 2016, which claims priority under 35 U.S.C. § 119 to German Patent Application No. 102015205964.2, filed on Apr. 1, 2015.

FIELD OF THE INVENTION

The present invention relates to a contact pin and, more particularly, to a contact pin with a contact section and a mounting section angled with respect to the contact section.

BACKGROUND

Known contact pins have a contact section and a mounting section which is angled with respect to the contact section and which is connected to the contact section in a transition region of the contact pin. The contact section connects to mating contact elements such as bushings or sheaths. The mounting section electrically connects and/or fixes the contact pin; for example, the mounting section can be connected to a circuit board. Contact pins with angled mounting sections are used to arrange the contact pins pointing substantially in a direction which runs parallel to a circuit board plane. Contact pins are frequently formed from rod-shaped blanks which are firstly inserted into a contact pin receptacle of a connector and then formed by suitable reshaping techniques such that the mounting section is angled relative to the contact section.

A disadvantage of the known contact pins is that the reshaping, for example by bending a rod-shaped blank, is an expensive and complex method which can lead to deviations between different contact pins; the transition regions between two different contact pins which have been produced from identical blanks and using an identical method may differ from one another. As a result, the geometry of the contact pin and also the conductive properties of the contact pin, in particular in the high-frequency region, are not precisely reproducible. A further disadvantage of known contact pins in which the mounting section is angled relative to the contact section is that high frequency signals can often only be transmitted with reduced signal quality.

SUMMARY

A contact pin according to the invention comprises a contact section, a mounting section angled with respect to the contact section, and a transition region connecting the contact section and the mounting section. The contact section extends substantially parallel to a contacting direction in which the contact pin is pressed into a contact pin receptacle. The transition region has a recess forming a substantially planar engagement surface.

BRIEF DESCRIPTION OF THE DRAWINGS

The invention will now be described by way of example with reference to the accompanying figures, of which.

DETAILED DESCRIPTION OF THE EMBODIMENT(S)

Figure 1:
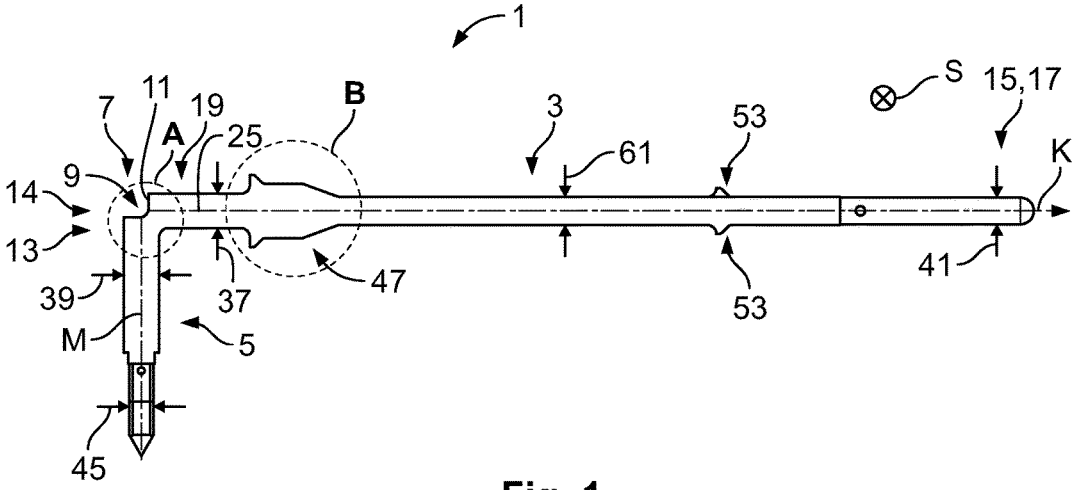
FIG. 1 is a top view of a contact pin according to the invention.

Exemplary embodiments of the present invention will be described hereinafter in detail with reference to the attached drawings, wherein like reference numerals refer to like elements. The present invention may, however, be embodied in many different forms and should not be construed as being limited to the embodiments set forth herein; rather, these embodiments are provided so that the present disclosure will be thorough and complete, and will fully convey the concept of the disclosure to those skilled in the art.

A contact pin 1 according to the invention is shown generally in FIGS. 1-4. The contact pin 1 has an elongated contact section 3, a mounting section 5 extending at an angle away from the contact section 3, and a transition region 7 connecting the contact section 3 and the mounting section 5.

In an embodiment, the contact pin 1 is formed monolithically with the contact section 3 and the mounting section 5; the contact section 3 and the mounting section 5 seamlessly merge into one another in the transition region 7. In this embodiment, the contact pin 1 is manufactured as a stamped part, wherein a stamping direction S of a stamping tool extends perpendicular to a plane spanned by the contact section 3 and the mounting section 5.

The contact section 3, as shown in FIG. 1, has an elongated shape and extends parallel to a contacting direction K. A free end 15 of the contact section 3 points in the contacting direction K. A longitudinal direction M of the mounting section 5 extends at a right angle to the contacting direction K. The mounting section 5 and the contacting section 3 are perpendicular to one another.

Figure 2:
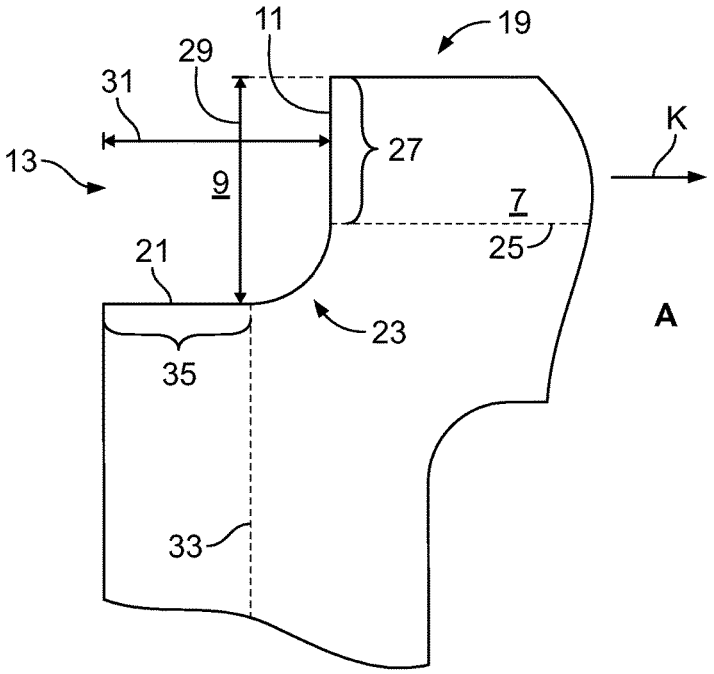
FIG. 2 is a detail top view of a transition region of the contact pin.

The transition region 7 is shown as the circle A in FIG. 1 and is also shown in FIG. 2. The transition region 7 has a recess 9 forming an engagement surface 11. The engagement surface 11 receives a press-in tool in order to press the contact pin 1, by its contact section 3, into a contact pin receptacle in the contacting direction K. Through the recess 9, the engagement surface 11 is accessible from outside the contact pin 1. The engagement surface 11 faces counter to the contacting direction K. As a result, a press-in tool can move the contact pin 1 in the contacting direction K or exert a force on the contact pin 1 in the contacting direction K. At the recess 9, the engagement surface 11 is open to a rear side 13 of the contact pin 1. The rear side 13 is formed by a transition end 14 of the contact pin 1 which extends counter to the contacting direction K. The free end 15 of the contact section 3 which extends in the contacting direction K accordingly forms a front side 17 of the contact pin 1.

The recess 9, as shown in FIGS. 1 and 2, has a substantially rectangular shape. The recess 9 extends from the rear side 13 and from an upper side 19 of the contact pin 1 into the transition region 7. The recess 9 forms two surfaces in the transition region 7; one of these surfaces is the engagement surface 11 already specified, and additionally, a guide surface 21 perpendicular to the engagement surface 11 is formed by the recess 9 in the contact pin 1. The guide surface 21 can guide a press-in tool to the engagement surface 11. Furthermore, the press-in tool can rest on the guide surface when pressing in, which can prevent the tool from slipping off of the engagement surface 11. The engagement surface 11 extends perpendicular to the contacting direction K. The guide surface 21 in the embodiment shown in FIGS. 1 and 2 extends parallel to the contacting direction K or parallel to the upper side 19.

A rounded region 23, as shown in FIGS. 1 and 2, is disposed between the engagement surface 11 and the guide surface 21. The rounded region 23 facilitates the stamping of the contact pin 1; in a stamping tool, due to the rounded region 23, it is possible to dispense with generating an exact rectangular shape with tapering surfaces which is generally costly and complex.

The engagement surface 11, as shown in FIG. 2, extends up to over a middle 25 of a cross-section of the contact section 3 into the transition region 7. In an embodiment, the engagement surface 11 extends over 70±5% of a height 37 of the contact section 3. The middle 25 of the cross-section of the contact section 3 extends along the contacting direction K. A planar section 27 of the engagement surface 11, situated outside of the rounded region 23, extends at least up to the middle of the cross-section 25 of the contact section 3. As a result, a large engagement surface 11 can be formed. In addition, a press-in tool, in the region of the middle 25 of the cross-section, can exert a force on the contact pin 1 in order to move the contact pin 1 by its contact section 3 in a straight line along the contacting direction K. In an embodiment, the planar section 27 extends from the upper side 19 up at least over half of a height 29 of the recess 9. In this case, the height 29 of the recess 9 is measured perpendicular to the contacting direction K starting from the upper side 19. In a further embodiment, the planar section 27 extends over at least two thirds of the height 29 of the recess 9.

A depth 31 of the recess 9, as shown in FIG. 2, is measured from the rear side 13 up to the engagement surface 11 parallel to the contacting direction K. The depth 31 of the recess 9 extends over a middle 33 of a cross-section of the mounting section 5. In an embodiment, the depth 31 of the recess 9 is 70±5% of a depth 39 of the mounting section 5. In other embodiments, the depth 31 of the recess 9 can also be less than 65% of the depth 39 of the mounting section 5. The guide surface 21 also has a planar section 35. The planar section 35 is the region of the guide surface 21 situated outside of the rounded region 23. The planar section 35 of the guide surface 21 extends over the middle 33 of the cross-section of the mounting section 5 into the transition region 7. In an embodiment, the engagement surface 11 and the guide surface 21 extend by the same depth into the transition region 7; the depth of the recess 31 and the height of the recess 29 are identical. In such an embodiment, the recess 9 has a square shape.

Adjacent to the transition region 7, as shown in FIG. 1, the contact section 3 has the height 37 which substantially corresponds to the depth 39 of the mounting section 5 in the proximity of the transition region 7. The height 37 of the contact section in the proximity of the transition region 7 is greater than a height 41 of the contact section at its free end 15. As a result, the contact section 3, in the transition region 7, has increased rigidity. The mounting section 5 likewise has at its free end 43 a depth 45 which is smaller than the depth 39 in the proximity of the transition region 7. The depth 45 can be selected such as required for attaching, for example, to a circuit board. The depth 39 which is increased compared to the depth 45 also has a positive effect on the stability of the contact pin 1. In embodiments, the contact section 3 can have a round cross-section at least at the free end 15; the shape of the cross-section can be dictated by requirements for an interface.

Figure 3:
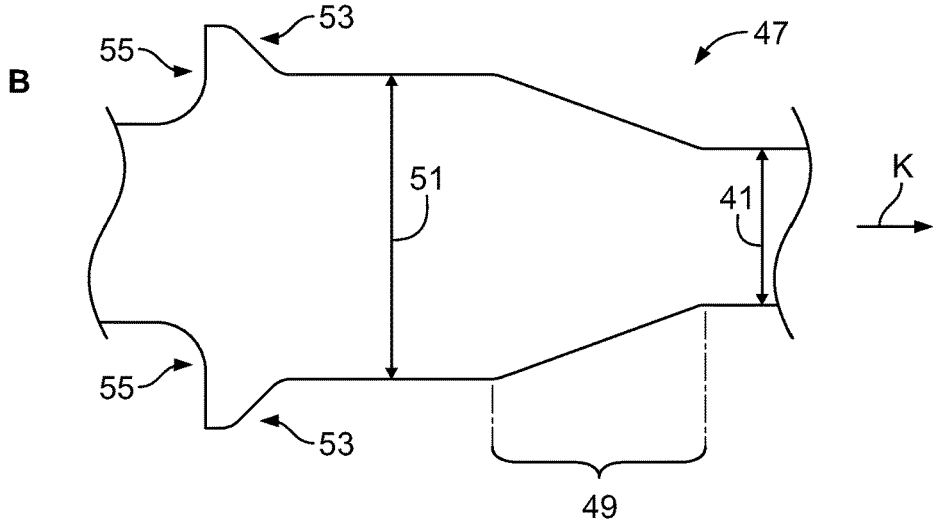
FIG. 3 is a detail top view of an attachment section of the contact pin.

An attachment portion 47, shown in FIG. 1 in the circle B and in FIG. 3, is disposed between the free end 15 of the contact section 3 and the transition region 7. The attachment section 47 holds the contact pin 1 in a contact pin receptacle. In other embodiments, the contact pin 1 can be formed without an attachment section 47.

The attachment section 47, as shown in FIG. 3, has a guide section 49 in which the height of the contact section 3 increases counter to the contacting direction K. An insertion or pressing-in of the contact pin 1 into a contact pin receptacle is facilitated by the guide section 49. Starting from the height 41 of the contact section 3, the guide section 49 expands the height of the contact section 3 up to an attachment section height 51.

In the attachment section 47, as shown in FIG. 3, at least one attachment projection 53 projects transverse to the contacting direction K. In other embodiments, the contact pin 1 is formed without these attachment projections 53. In the shown embodiment, two attachment projections 53, which are aligned with another transverse to the contacting direction K, project transverse to the contacting direction K. In the shown embodiment, the attachment projections 53 are shaped as barbs; firstly broadening counter to the contacting direction K and then, at a rear end 55, extending perpendicular to the contacting direction K. The attachment projections 53 penetrate into a material of the contact pin receptacle in order to securely retain the contact pin 1 in a contact pin receptacle. In an embodiment, a contact pin receptacle has an inner diameter approximately equal to the attachment section height 51 and the attachment projections 53 extend into the material of the contact pin receptacle. Between the attachment section 47 and the free end 15, the contact section 3 can have additional attachment projections 53 in other embodiments which are also disposed opposite one another in pairs transverse to the contacting direction K. These can serve to additionally secure the contact section 3 in a contact pin receptacle.

Figure 4:
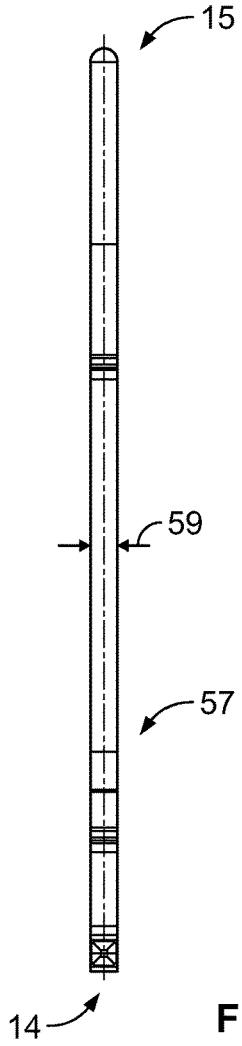
FIG. 4 is a bottom view of the contact pin.

An underside 57 of the contact pin 1 is shown in FIG. 4. The contact pin 1 has a continuous uniform thickness 59. The thickness 59 is dictated by the thickness of the material out of which the contact pin 1 is stamped. The thickness 59 is identical to a height 61 of the contact section 3 between the attachment section 47 and the attachment projections 53 at the free end 15, shown in FIG. 1. In this region, the contact section 3 has a square cross-section. The height 41 of the contact section 3 at the free end 15 is slightly smaller than the height 61.

Figure 5:
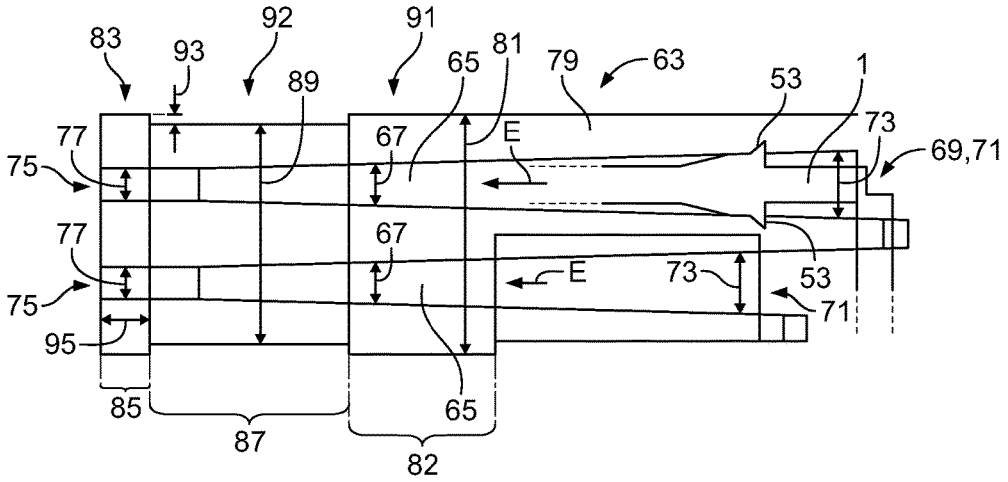
FIG. 5 is a sectional side view of a contact pin receptacle according to the invention receiving the contact pin.

A contact pin receptacle 63 according to the invention is shown in FIG. 5. In an embodiment, the contact pin receptacle 63 is part of a connector. The contact pin receptacle 63 has two shafts 65 for receiving contact pins 1; FIG. 5 shows a contact pin 1 received in the uppermost of the two shafts 65. FIG. 5 shows the contact pin receptacle 63 in a section parallel to a press-in direction E, which coincides with the contacting direction K of contact pins 1 when the contact pins 1 are received in the shafts 65.

The shafts 65, as shown in FIG. 5, extend longitudinally parallel to the press-in direction E. A shaft height 67 decreases in the press-in direction E. The shafts 65 have, at their ends 69 pointing counter to the press-in direction E, insertion apertures 71 for inserting contact pins 1. The insertion apertures 71 have a height 73 which corresponds at least to the height 51 of the attachment section of a contact pin 1, insofar as the contact pin 1 has an attachment section 53. At their ends 75 pointing in the press-in direction E, the shafts 65 can have a height 77 which substantially corresponds to the height 41 of the contact section 3 at the free end 15. The height 77 is smaller than the height 73 leading to the above-described shaft height 67 which decreases in the press-in direction E.

A contact pin 1 received in a shaft 65 can be securely retained in the contact pin receptacle 63 by its attachment projections 53 penetrating into a material 79 of the contact pin receptacle 63. In an embodiment, the material 79 is formed from a dielectric such as a polyamide or a liquid crystal polymer.

The contact pin receptacle 63, as shown in FIG. 5, has a maximum height 81. The maximum height 81 is present at a middle region 82 in the press-in direction E. The contact pin receptacle 63 has the maximum height 81 at the front end 83 which points in the press-in direction E. The contact pin receptacle 63 extends with the maximum height 81 from the front end 83 along the press-in direction E over a front section 85. Between the middle region 82 and the front section 85, the contact pin receptacle 63 has at least one reduction section 87 having a reduced height 89. In this case, a reduced height 89 in the reduction section 87 is smaller than the maximum height 81. The reduction section 87 has a cross-sectional taper 92. The reduction section 87 is, in the press-in direction E, around three to five times, and in other embodiments four times, as long as the front section 85. Alternatively, in other embodiments, the front section 85 can also have the reduced height 89; in this case, the reduction section 87 extends up to the front end 83. In another alternative embodiment, the reduction section 87 is interrupted at at least one location by a region in which the height corresponds to the maximum height 81; as a result, several reduction sections 87 ranged behind one another in the press-in direction E can be formed.

The cross-sectional taper 92 is formed in that the material 79 is removed from the contact pin receptacle 63 in an outer region 91 surrounding the shafts 65. A depth 93 of the removed material is one fourth to one sixth of the length 95 of the front section 85. As a result of the reduction section 87, the line quality of a connector according to the invention can be improved, and the impedance trajectory is homogenized. Together with a contact pin 1 according to the invention which, as a result of the recess 9, has a good transmission quality, it is possible for a connector to be created which can be produced quickly and inexpensively by stamping the contact pins 1 and pressing the contact pins 1 into the contact pin receptacle 63, and which additionally has good transmission properties, in particular for the high-frequency region.

Figure 6:
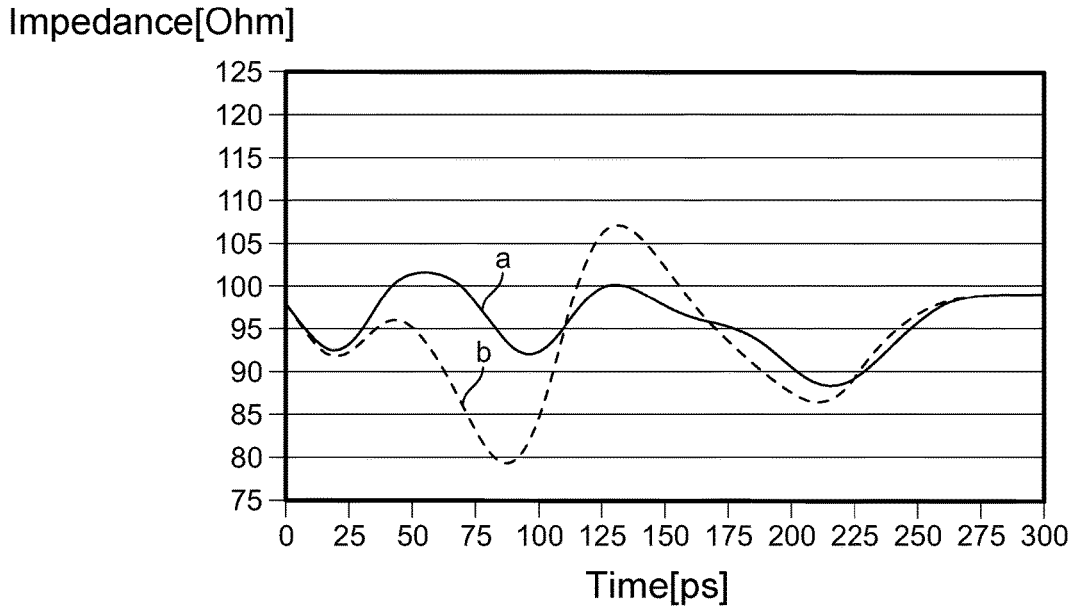
FIG. 6 is a graph of time-interval reflectometry on the contact pin according to the invention compared to a contact pin without a recess.

The results of simulation calculations are shown in FIG. 6 for time-interval reflectometry on the contact pin 1 shown in FIGS. 1-4. In this case, the impedance has been calculated in response to a pulse with 50 ps of rise time. For simulation, the contact pin 1 has been calculated when inserted in a contact pin receptacle 63 according to the invention, which is described with reference to FIG. 5, and furthermore a continuous mating plug (180° plug) which is connected to the free end 15 of the contact section 3 has been assumed in order to generate realistic conditions.

In FIG. 6, curve a shows simulation results for the contact pin 1 in the contact pin receptacle 63, wherein the contact pin 1 has a contact section 3 with a height 37 of 0.8±0.05 mm and a mounting section 5 with a depth 39 of 0.8±0.05 mm. The recess 9 in this case extends into the transition region 7, such that the height 29 of the recess 9 is 70±5% of the height 37 of the contact section 3 and the depth 31 of the recess 9 is 70±5% of the depth 39 of the mounting section 5. Depending on the requirements, other values may also be selected. In another embodiment, the depth 39 and the height 37 are each 1±0.05 mm. Other values are also possible. The depth 39 and the height 37 also need not necessarily be of the same size.

The curve b of FIG. 6 shows simulation results for a contact pin which has substantially the same shape as the contact pin 1 according to the invention but has no recess 9 in the transition region 7, but rather is formed such that the contact section 3 and the mounting section 5 abut one another at a right angle. In addition, the simulated contact pin of curve b is received in a contact pin receptacle which has no reduction section 87.

The transition region 7 is arranged approximately in the time region between 75 and 100 ps. It can clearly be seen that curve has a substantially smaller interference point in the impedance trajectory in this region. The contact pin 1 therefore has particularly good conductive properties in the high-frequency region. In addition, it can be seen in FIG. 6 that an interference point in the impedance trajectory in the region from 200 to 225 ps decreases significantly more greatly in the case of curve b than in the case of curve a. This can be attributed to the optimized contact pin receptacle 63 having the reduction section 87.

What is claimed is:

1. A contact pin, comprising:

a contact section extending substantially parallel to a contacting direction in which the contact pin is pressed into a contact pin receptacle;

a mounting section angled with respect to the contact section; and a transition region connecting the contact section and the mounting section, the transition region having a recess forming a substantially planar engagement surface, a depth of the recess extends from a rear side of the contact pin in the contacting direction to over a middle of a cross-section of the mounting section, the depth of the recess is less than a depth of the mounting section in the contacting direction, a height of the recess extends in a direction parallel to the mounting section into the transition region from an upper side edge of the contact pin opposite the mounting section.

2. The contact pin of claim 1, wherein the engagement surface faces counter to the contacting direction.

3. The contact pin of claim 1, wherein the recess is substantially rectangular.

4. The contact pin of claim 1, wherein the engagement surface extends substantially perpendicular to the contacting direction.

5. The contact pin of claim 1, wherein the engagement surface extends from the upper side edge of the contact pin to at least over a middle of a cross-section of the contact section.

6. The contact pin of claim 1, wherein a planar section of the engagement surface extends perpendicular to the contacting direction.

7. The contact pin of claim 6, wherein the planar section of the engagement surface extends from the upper side edge of the contact pin to at least over a middle of a cross-section of the contact section.

8. The contact pin of claim 6, wherein the planar section of the engagement surface extends from the upper side edge of the contact pin to at least over half the height of the recess, the height of the recess extending in a direction perpendicular to the contacting direction.

9. The contact pin of claim 1, wherein the contact section, the mounting section, and the transition region are formed monolithically.

10. The contact pin of claim 1, wherein the mounting section extends perpendicular to the contact section.

11. The contact pin of claim 10, wherein a planar section of the engagement surface extends perpendicular to the contacting direction from the upper side edge of the contact pin to at least over a middle of a cross-section of the contact section.

12. The contact pin of claim 8, wherein the height of the recess is less than a height of the contact section in the direction perpendicular to the contacting direction.

13. The contact pin of claim 1, wherein the recess forms a substantially planar guide surface perpendicular to the engagement surface and a rounded region is disposed between the engagement surface and the guide surface.

14. A connector, comprising:

a contact pin receptacle having a shaft extending along a press-in direction; and a contact pin having a contact section extending substantially parallel to the press-in direction and received in the shaft, a mounting section angled with respect to the contact section, and a transition region connecting the contact section and the mounting section, the transition region having a recess forming a substantially planar engagement surface, a depth of the recess extends from a rear side of the contact pin in the contacting direction to over a middle of a cross-section of the mounting section, the depth of the recess is less than a depth of the mounting section in the contacting direction, a height of the recess extends in a direction parallel to the mounting section into the transition region from an upper side edge of the contact pin opposite the mounting section.

15. The connector of claim 14, wherein the contact pin receptacle is formed of a dielectric material.

16. The connector of claim 14, wherein the contact pin has an attachment projection extending from the contact section and securing the contact pin in the shaft.

17. The connector of claim 14, wherein the contact pin receptacle has a reduction section disposed between a front section and a middle region along the press-in direction, the reduction section having a reduced height smaller than a height of the front section and the middle region.

18. The connector of claim 14, wherein the contact pin receptacle has a cross-sectional taper extending along the press-in direction.

19. A connector, comprising:

a contact pin receptacle having a shaft extending along a press-in direction, the contact pin receptacle has a reduction section disposed between a front section and a middle region along the press-in direction, the reduction section having a reduced height smaller than a height of the front section and the middle region; and a contact pin having a contact section extending substantially parallel to the press-in direction and received in the shaft, a mounting section angled with respect to the contact section, and a transition region connecting the contact section and the mounting section, the transition region having a recess forming a substantially planar engagement surface, a depth of the recess extends from a rear side of the contact pin in the contacting direction to over a middle of a cross-section of the mounting section, the depth of the recess is less than a depth of the mounting section in the contacting direction.

* * * * *